United States Patent [19]

Izumisawa

[11] Patent Number: 4,821,611

[45] Date of Patent: Apr. 18, 1989

[54] TIGHTENING DEVICE

[75] Inventor: Osamu Izumisawa, Nagano, Japan

[73] Assignee: Shinano Pneumatic Industries Inc., Nagano, Japan

[21] Appl. No.: 38,674

[22] Filed: Apr. 15, 1987

[30] Foreign Application Priority Data

Apr. 16, 1986 [JP] Japan ..... 61-85986

[51] Int. Cl.[4] ..... B25B 19/00

[52] U.S. Cl. ..... 81/464; 81/57.29; 173/93.6

[58] Field of Search ..... 81/464, 57.29; 173/93.6

[56] References Cited

U.S. PATENT DOCUMENTS

| | | | |
|---|---|---|---|
| 2,564,224 | 8/1951 | Mitchell et al. | 173/93.6 |
| 3,389,623 | 6/1968 | Gill | 81/464 |
| 4,346,630 | 8/1982 | Hanson | 81/57.29 |

*Primary Examiner*—Frederick R. Schmidt
*Assistant Examiner*—Maurina Rachuba
*Attorney, Agent, or Firm*—Schwartz & Weinrieb

[57] ABSTRACT

By transferring the power fed from a motor to a ratchet mechanism through means of an impact clutch mechanism, a relatively large torque is obtained by the impact clutch mechanism. In addition when a torque greater than a predetermined level is applied to the ratchet mechanism, reaction is never given to the operator's hand because the impact clutch mechanism does not transfer a force greater than the present torque to the ratchet mechanism, thus permitting safe operation. With the ratchet mechanism, moreover, it becomes possible to effect such operation as first loosening and removing by the operator's force such members as bolts and nuts which have been additionally tightened independently or strongly tightened to a level in excess of a certain torque preset for the device.

20 Claims, 2 Drawing Sheets

TIGHTENING DEVICE

FIELD OF THE INVENTION

The present invention relates to a tightening device for tightening and securing bolts, nuts, or other members, in positions where they are to be located, and also for loosening and removing such members already tightened and secured.

BACKGROUND OF THE INVENTION

As conventional methods for tightening and securing bolts, nuts, or other members, in positions where they are to be located, and also for loosening and removing such members already tightened and secured, there have been known a method in which the power fed from a motor is transferred to a rotatable tightening portion through means of an impact clutch mechanism, and a method in which the power fed from a motor is transferred to a rotatable tightening portion through means of a gear mechanism and a ratchet mechanism.

In the former method of transferring the power from a motor to a rotatable tightening portion through means of an impact clutch mechanism, a relatively large torque is obtained without imparting a reaction to the operator's hand and safe operation can be attained. However, the level of torque is constant, the application of a greater torque causes the clutch to turn OFF, and thus it is impossible to obtain a torque greater than a preset value. In a tightening operation, therefore, after a bolt, a nut, or any other member was tightened with a predetermined torque at a position at which the member is to be located, it is impossible to effect additional tightening by means of the impact device. Conversely, in performance of a loosening operation, it is impossible to first loosen and remove by means of the impact device the above member once the member is strongly tightened with an amount of torque exceeding the torque capacity of the device.

In the latter method of transferring the power from a motor to a rotatable tightening portion through means of a gear mechanism and a ratchet mechanism, a bolt, a nut, or any other member which has been secured by additional tightening or by strongly tightening the member with an amount of torque which is in excess of the torque capacity of the device, can be initially loosened and removed by means of the operator's force. However, if the device is rotatably operated at a torque level which exceeds the tightened torque, the device itself will rotate, so that the operator's hand which holds the device is suddenly moved in the rotating direction, thus often resulting in injury.

SUMMARY OF THE INVENTION

The present invention contemplates solving the above-mentioned problems and it is an object thereof to provide a tigthening device whereby a member which has been secured by additional tightening or by strongtly tightening the member with an amount of torque which is in excess of a predetermined torque level, can be initially loosened and removed by the operator's force, and wherein a relatively large torque is obtained; and in addition force are, reaction is not imparted to the operator's hand, thus ensuring safe operation.

BRIEF DESCRIPTION OF THE DRAWINGS

Other objects, advantages and features of the present invention will become more apparent from the following description when taken in connection with the accompanying drwings, wherein like reference characters designate like or corresponding parts throughout the several views, and wherein.

DESCRIPTION OF A PREFERRED EMBODIMENT

Figure 2:
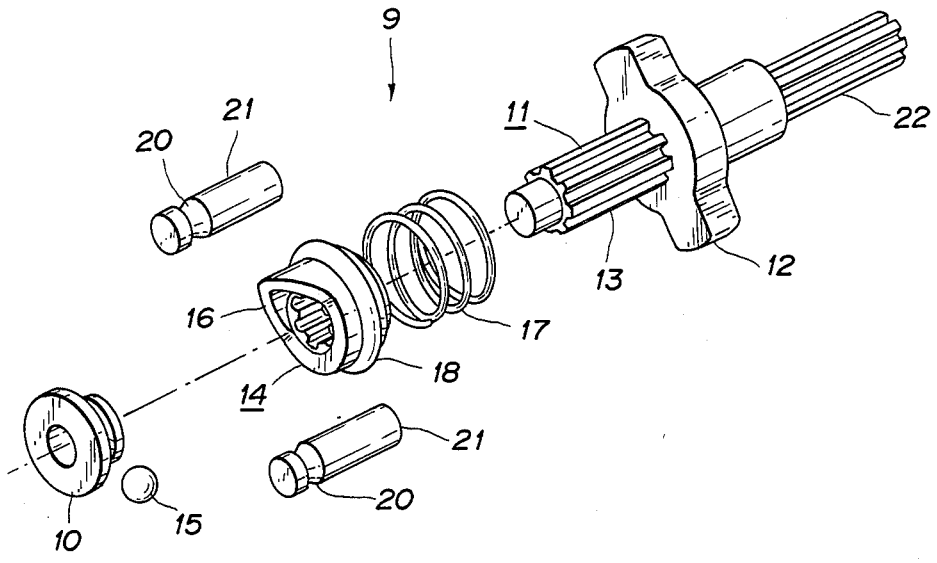
FIG. 2 is a schematic perspective view of an impact clutch mechanism used in the tightening device, in a disassembled state for assembly.

An embodiment of the present invention will now be described with reference to the accompanying drawings. In the drawings, the reference numeral 1 denotes a motor, for example, an air motor or an electric motor. In this embodiment there is used an air motor as the motor 1. By operating an opening/closing lever 2, pressurized air is introduced from an air inlet portion 3 which is connected to an air source (not shown), so as to rotate the air motor 1 which is disposed in a body 4. A main driving shaft 5 of the air motor 1 is connected to a clutch case 6. The clutch case 6, which is C-shaped in section, has a receiving chamber 7 formed in the interior thereof, and it is rotatably disposed within a casing 8 which is connected to the body 4. In a central axial position of the interior of the receiving chamber 7 there is provided an impact spindle 11 which has its proximal end mounted within a bearing 10 which is provided for preventing the transfer of the rotational movement of the clutch case 6 to the impact spindle 11. Projecting radially outwardly from the impact spindle 11 are a pair of striking collars 12 as best seen in FIG. 2, and a cam 14 is axially slideable upon a spline 13 which is formed in the axial direction upon the impact spindle 11. Furthermore, a tapered cam surface 16 of the cam 14 is normally urged against a ball 15 disposed in combination with the bearing 10, by virtue of a biasing spring 17.

On the outer peripheral surface of the cam 14 there is formed an annular projection 18, and hammer pins 21 each having an annular recess 20 engaged with the annular projection 18 extend axially so as to be slideable between the cam 14 and the inner surface of the clutch case 6.

In an impact clutch mechanism 9 constructed as above, a fore spline 22 of the impact spindle 11 projects outwardly (to the right in FIG. 1) from the casing 8 so as to be disposed within a housing 24 which is connected to the casing 8 through means of a connecting member 23, and a crank shaft 25 is connected to the fore spline 22. The crank shaft 25 has a fixed shaft 27 projecting from a fore end-face 26 at a position eccentric from the axis, and a bushing 28 is rotatably connected to the fixed shaft 27. The bushing 28 is rotatably disposed in a spherical slot 31 of a yoke 30, which yoke is connected to a rotatable tightening portion 33 through means of a ratchet mechanism 32.

Figure 1:
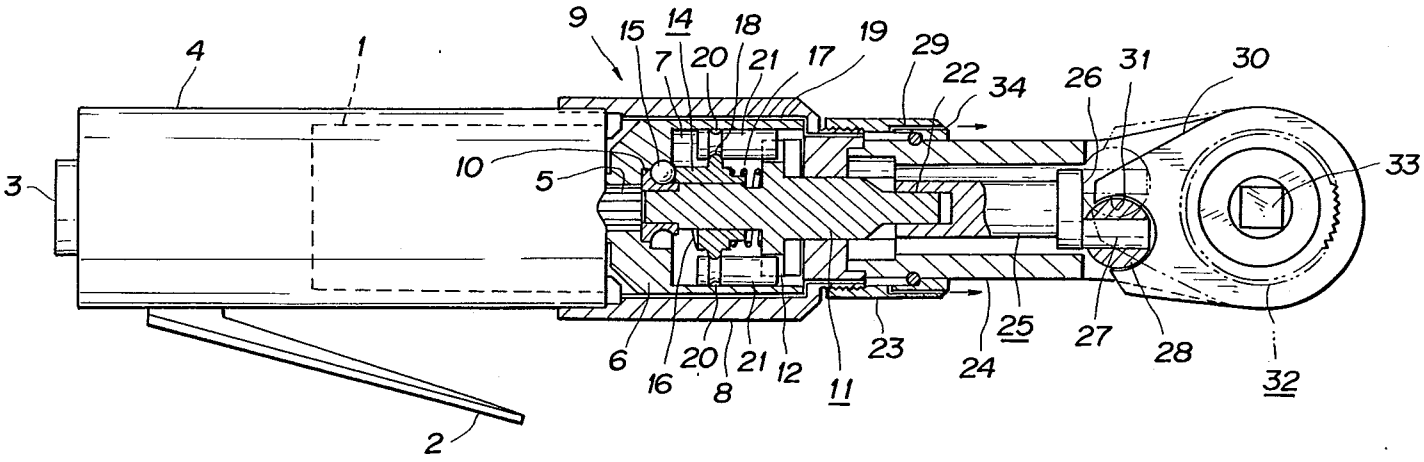
FIG. 1 is a side view of a tightening device according to an embodiment of the present invention, with a principal portion thereof being broken away.

The casing 8 and the connecting member 23 are formed with a first exhaust passage 19 and a second exhaust passage 29, respectively. the air from the air motor 1 is conducted through those passages and ejected in the direction of the arrow in FIG. 1 from a fore port 34 of the second exhaust passage 29.

In connecting the rotatable tightening portion 33 to a bolt, a nut, or any other member to be tightened and for performing the tightening operation with the device of the above construction, first the air motor 1 is driven by operating the opening/closing lever 2, whereby the clutch case 6 connected to the main driving shaft 5 of the air motor 1 is rotated integrally with the shaft 5, thereby causing the bearing 10, ball 15 and hammer pins 21 to be rotated together with the clutch case 6. As a result, the ball 15 slides with respect to the cam surface 16 of the cam 14 which is in a non-rotating state, causing the cam 14 to slide axially in accordance with the spline 13 of the impact spindle 11, so that the hammer pins 21 which are in an engaged relation with respect to the cam 14 through means of the annular projection 18 and the annular recesses 20 also slide axially while rotating. With this axial sliding in motion rotating state of the hammer pins 21, the same pins strike the strike collars 12 of the impact spindle 11 when the ball 15 is positioned at the projecting end of the cam surface 16. On the other hand, the projecting end of the cam surface 16 and the ball 15 are disengaged from each other just after or just before the aforenoted stroking of the collars 12 by means of the pins 21, so that the cam 14 slides toward the air motor 1 under the restoring force of the biasing spring 17. Consequently, the hammer pins 21 also slide and move away from the rotating region of the striking collars 12 so as to discontinue the striking state of the hammer pins 21 upon the striking collars 12, allowing the impact spindle 11 to rotate. When the cam 14 is again moved axially toward the right, as viewed in FIG. 1, as a result of the next contact of the ball 15 with the fore end of the cam surface 16, the hammer pins 21 again strike the striking collars 12.

As mentioned above, the hammer pins 21 move away from the rotating region of the striking collars 12 just after striking the collars 12, so even in the event that an external torque greater than a preset value is applied to the impact spindle 11, the striking is merely repeated without impacting a shock to the operator's hand or without causing the device to be rotated by reaction forces. The rotation of the impact spindle 11 created by the above striking is transmitted to the yoke 30 through means of the crank shaft 25 so as to cause the yoke 30 continuously perform an oscillating motion, and this oscillating motion is converted to a rotating motion of the rotatable tightening portion 33 by means of the ratched mechanism 32. After the tightening operation by means of the impact mechanism 9 is completed, the air motor 1 is turned off by operating the opening/closing lever 2 and in this state the body 4 is rotated in the tightening direction by means of the operator's hand, whereby the member to be secured such as a bolt or a nut can be additionally tightened (because in this case the rotatable tightening portion is prevented from racing by means of the ratchet mechanism 32).

In order to remove a tightened bolt, nut or any other member, the rotating direction of the rotatable tightening portion 33 is changed or reversed by means of a change-over mechanism (not shown) for the ratchet mechanism 32 and the tightened member is first loosened by means of the operator's hand while holding the body 4 followed by the same operations as above whereby the rotating direction is reversed and the tightened member can be removed in just the same manner as noted above.

The impact clutch mechanism in the present invention is not always required to be of the above pin clutch type. There may be used any other suitable impact clutch mechanism such as, for example, a two hammer type, a one hammer type, or a Maurer clutch type created by Mr. Maurer.

The rotation of the impact spindle 11 is transferred to the yoke 30 through means of the crank shaft 25, thereby causing the yoke 30 to perform an oscillating motion, as mentioned above. At this time, the rotation of the bushing 28 disposed within the slot 31 induced continuous friction with a considerable force relative to the inner surface of the slot 31, so that the portion of the yoke 30 is heated by means of the frictional heat. However, the air from the air motor 1 is conducted to the first and second exhaust passages 19 and 29 and ejected in the direction of the arrow in FIG. 1 from the fore port 34, so that the portion of the device in front of the port 34, particularly the portion of the yoke 30 and its circumference is cooled by the air, whereby the fore end portion of the device, especially the yoke 30, is prevented from being overheated even when this device is used for a long time. Heretofore, the air from the air motor 1 has been merely discharged to the exterior atmosphere from the body 4, while in the device of the present invention the air from the air motor can be utilized effectively.

In the present invention constructed as above, the power fed from the motor is transferred to the impact clutch mechanism, whereby a relatively large torque is obtained. Besides, even in the event a torque greater than a predetermined level is directed toward the ratched mechanism, reaction is not imparted to the operator's hand because the impact clutch mechanism does not transfer a force greater than the present torque to the ratchet mechanism, thus permitting safe operation. With the ratchet mechanism, moreover, it is possible to first loosen and remove by means of the operator's force a bolt, a nut, or any other member, which has been additionally tightened independently or strongly tightened to a degree in excess of a certain torque preset for the device.

Obviously, many modifications and variations of the present invention are possible in light of the above teachings. It is therefore to be understood that within the scope of the appended claims, the present invention may be practiced otherwise than as specifically described herein.

I claim:

1. A tool for tightening or loosening structural members, such as, for example, bolts, nuts, and the like, comprising:

rotatable means operatively connectable to one of said structural members for rotatably tightening or loosening said one of said structural members;

oscillating ratchet means operatively connected to said rotatable means for causing rotatable movement of said rotatable means in a predetermined rotational direction;

rotatable impact drive means for driving said oscillating ratchet means;

means interconnecting said rotatable impact drive means and said oscillating ratchet means for converting rotatable drive movement of said rotatable impact drive means into oscillating drive movement for said oscillating ratchet means;

a casing for housing a first proximal end of said impact drive means;

an air motor operatively connected to said first proximal end of said impact drive means;

a housing for enclosing a second distal end of said impact drive means;

a connecting member interconnecting said casing and said housing;

a first exhaust passage defined within said casing for exhausting exhaust air from said air motor toward said connecting member and said housing; and a second exhaust passage defined within said connecting member for exhausting said exhaust air from said first exhaust passage toward said means interconnecting said rotatable impact drive means and said oscillating ratchet means for cooling said means interconnecting said rotatable impact drive means and said oscillating means within which frictional heat is generated as a result of operative movement thereof during conversion of said rotatable drive movement of said rotatable impact drive means into said oscillating drive movement of said oscillating ratchet means.

2. A tool as set forth in claim 1, wherein:

said impact drive means comprises an impact clutch mechanism.

3. A tool according to claim 2, wherein said impact clutch mechanism is a one hammer type.

4. A tool according to claim 2, wherein said impact clutch mechanism is a two hammer type.

5. A tool according to claim 2, wherein said impact clutch mechanism is a pin clutch type.

6. A tool as set forth in claim 1, further comprising:

lever means mounted upon said tool for controlling or preventing the admission of air to said air motor.

7. A tool as set forth in claim 1, wherein:

said rotatable impact drive means includes a male splined shaft section defined upon the distal end of said rotatable impact drive means; and said rotatable crankshaft includes a female splined socket interengaged with said male splined shaft section of said rotatable impact drive means.

8. A tool as set forth in claim 1, further comprising:

a body for housing said air motor; and air inlet means defined upon said body for introducing air into said body and to said air motor for driving said air motor.

9. A tool as set forth in claim 8, further comprising:

lever means mounted upon said body and interposed between said air inlet means and said air motor for permitting or preventing the admission of air to said air motor.

10. A tool for tightening or loosening structural members, such as, for example, bolts, nuts, and the like, comprising:

rotatable means operatively connectable to one of said structural members for rotatably tightening or loosening said one of said structural members;

oscillating ratchet means operatively connected to said rotatable means for causing rotatable movement of said rotatable means in a predetermined rotational direction;

rotatable impact drive means for driving said oscillating ratchet means;

a rotatable crankshaft operatively connected to said rotatable impact drive means;

a drive shaft eccentrically mounted upon said rotatable crankshaft;

spherical slot means defining within said oscillating ratchet means;

a spherical bushing rotatably mounted upon said eccentric drive shaft and disposed wtihin said spherical lot means of said oscillating ratchet means;

an air motor operatively connected to a first proximal end of said impact drive means for rotatably driving said rotatable impact drive means;

ON-OFF control means for controlling said air motor, and, in turn, said rotatable impact drive means and said oscillating ratchet means whereby when said air motor is ON, said one of said structural members is tightened or loosened by means of a combination drive movement of both said impact drive means and said ratchet means, whereas when said air motor is OFF, said one of said structural members is tightened or loosened by means of a drive movement of said ratchet means as a result of manual force being imparted to said tool;

a casing for housing said first proximal end of said impact drive means;

a housing for enclosing a second distal end of said impact drive means;

a connecting member interconnecting said casing and said housing;

a first exhaust passage defined within said casing for exhausting exhaust air from said air motor toward said connecting member and said housing; and a second exhaust passage defined within said connecting member for exhausting said exhaust air from said first exhaust passage toward said bushing of said eccentric drive shaft and said spherical slot means of said oscillating ratchet means for cooling said bushing and said slot means between which frictional heat is generated as a result of relative movement therebetween during conversion of rotatable drive movement of rotatable impact drive means into oscillating drive movement of said oscillating ratchet means.

11. A tool as set forth in claim 10, further comprising:

a body for housing said air motor; and air inlet means defined upon said body for introducing air into said body and to said air motor for driving said air motor;

said ON-OFF control means comprising lever means mounted upon said body and interposed between said air inlet means and said air motor for permitting or preventing the admission of air to said air motor.

12. A tool as set forth in claim 10, wherein:

said impact drive means comprises an impact clutch mechanism.

13. A tool as set forth in claim 10, wherein:

said rotatable impact drive means inclues a male splined shaft section defined upon said distal end of said rotatable impact drive means; and said rotatable crankshaft includes a female splined socket interengaged with said male splined shaft section of said rotatable impact drive means.

14. A tool for tightening or loosening structural members, such as, for example, bolts, nuts, and the like, comprising:

rotatable means operatively connectable to one of said structural members for rotatably tightening or loosening said one of said structural members;

oscillating ratchet means operatively connected to said rotatable means for causing rotatable movement of said rotatable means in a predetermined rotational direction;

rotatable impact drive means for driving said oscillating ratchet means;

a rotatable crankshaft operatively connected to said rotatable impact drive means;

a drive shaft eccentrically fixed upon said rotatable crankshaft;

spherical slot means defined within said oscillating ratchet means;

a bushing rotatably mounted upon said eccentric drive shaft and disposed within said spherical slot meas of said oscillating ratchet means;

a casing for housing a first proximal end of said impact drive means;

an air motor operatively connected to said first proximal end of said impact drive means;

a housing for enclosing a second distal end of said impact drive means;

a connecting member interconnecting said casing and said housing;

a first exhaust passage defined within said casing for exhausting exhaust iar from said air motor toward said connecting member and said housing; and a second exhaust passage defined within said connecting member for exhausting said exhaust air from said first exhaust passage toward said bushing of said eccentric drive shaft and said spherical slot means of said oscillating ratchet means for cooling said bushing and said spherical slot means between which frictional heat is generated as a result of relative movement therebetween during conversion of said rotatable drive movement of said rotatable impact drive means into said oscillating drive movement of said oscillating ratchet means.

15. A tool as set forth in claim 14, wherein:

said impact drive means comprises an impact clutch mechanism.

16. A tool as set forth in claim 15, wherein:

said impact clutch mechanism is a one hammer type mechanism.

17. A tool a sset forth in claim 15, wherein:

said impact clutch mechanism is a two hammer type mechanism.

18. A tool as set forth in claim 15, wherein:

said impact clutch mechanism is a pin clutch type mechanism.

19. A tool as set forth in claim 14, further comprising:

lever means mounted upon said tool for controlling or preventing the admission of air to aid air motor.

20. A tool as set forth in claim 14, wherein:

said rotatable impact drive means includes a male splined shaft section defined upon said distal end of said rotatable impact drive means; and said rotatable crankshaft includes a female splined socket interengaged with said male splined shaft section of said rotatable impact drive means.

* * * * *